US006966619B2

(12) United States Patent
Muller

(10) Patent No.: US 6,966,619 B2
(45) Date of Patent: Nov. 22, 2005

(54) PULL-OUT SAFEGUARD, IN PARTICULAR FOR A DRAWER CABINET

(75) Inventor: Thomas Muller, Romanshorn (CH)

(73) Assignee: Lista Holding Europa AG, Fabrikstrasse (CH)

( * ) Notice: Subject to any disclaimer, the term of this patent is extended or adjusted under 35 U.S.C. 154(b) by 173 days.

(21) Appl. No.: 10/314,665

(22) Filed: Dec. 9, 2002

(65) Prior Publication Data

US 2003/0127953 A1 Jul. 10, 2003

(30) Foreign Application Priority Data

Dec. 21, 2001 (CH) ..... 2341/01

(51) Int. Cl.[7] ..... E05B 65/46
(52) U.S. Cl. ..... 312/221; 312/217
(58) Field of Search ..... 312/215, 216, 312/217, 218, 219, 220, 221, 222

(56) References Cited

U.S. PATENT DOCUMENTS 4,804,876 A * 2/1989 Lannert et al. ..... 312/221
5,605,388 A * 2/1997 Laakso ..... 312/218
5,671,985 A * 9/1997 Grieser et al. ..... 312/221

FOREIGN PATENT DOCUMENTS

CH 88353 * 7/1921
DE 4342101 * 6/1994
WO WO 96/25577 * 8/1996

* cited by examiner

*Primary Examiner*—James O. Hansen
(74) *Attorney, Agent, or Firm*—Cesari and McKenna, LLP; John F. McKenna

(57) ABSTRACT

A pull-out safeguard for a drawer cabinet, having a multiplicity of elements (20) which are arranged essentially in a row and can be displaced, a guide means (40) for guiding the elements (20), adjusting elements (50) which are connected to the drawers (12) to be secured, for adjusting the vertical position of the elements (20), and a restricting means (26) for restricting the displaceability of the elements (20). The adjusting elements (50) interact with the drawers (12) to be secured in such a manner that at the beginning of a pull-out movement of one of the drawers (12) to be secured, they move one of the elements (20) and all of the other elements (20) which are situated in one of the directions of the row, but, after a certain pull-out position of the pulled-out drawer (12), are moved back into their starting position by the gravitational force and/or the spring force of a spring element and/or a different driver driving back the elements (20).

3 Claims, 4 Drawing Sheets

PULL-OUT SAFEGUARD, IN PARTICULAR FOR A DRAWER CABINET

The present invention relates to a pull-out safeguard, in particular for a drawer cabinet. Furthermore, the invention relates to the use of a pull-out safeguard of this type in a drawer cabinet, and to a drawer cabinet provided with the pull-out safeguard.

Cabinets and cabinet systems are used in many sectors of trade and industry, for example as stationary or mobile tool cabinets in the industrial manufacturing sector or in the workshop sector. Since heavy tools or work pieces are often stored in such cabinets, tilting of the cabinets during opening of drawers has to be avoided. It is thus already been known for a long time to provide cabinets of this type with an individual pull-out safeguard. The latter is intended to ensure that only one drawer can be opened, rather than a plurality of drawers at the same time, in order thereby to reduce the tilting moment resulting from the pulled-out drawers.

It turns out that in a number of areas of use, safety requirements have to be satisfied which earlier cabinets do not satisfy. For example, it is to be prevented that just anyone has access to safety-sensitive components or tools which are stored in cabinets. This would be simple per se to achieve by these elements being locked away in compartments in the cabinets. However, in order to have access to them, the corresponding compartments would have to be continuously unlocked and locked, which would considerably interfere with the working procedure. In addition, each compartment would have to be provided with its own lock and key, which increases the structural outlay. In addition, a relatively large organizational outlay would also be associated with such a solution, since it would have to be checked which people obtain keys for which drawers. If the access authorizations change, the return of a multiplicity of keys would have to be monitored and their re-issuing organized.

WO-A-96/25577 discloses a locking device which comprises at least one cabinet which has a plurality of drawers which are separated from one another, can be pulled out and are arranged on a housing of the cabinet, it being possible for compartments of the cabinet to be locked and unlocked by a fastening device, for which purpose each of these cabinets is provided with a switchable catch which is assigned to it. In the case of the locking device, an access authorization device is also provided. Each compartment can be locked and unlocked separately with its catch. In comparison with the devices of the earlier prior art, the locking device disclosed in WO-A-96/25577 already has the advantage that the locking device can be formed in the rear region of the cabinet whereas, in the case of the earlier cabinets, a lateral fitting of the locking device has generally been provided.

However, it turns out that the locking device of WO-A-96/25577 can still be improved with regard to a number of points. Firstly, the problem has occurred that the individual pull-out safeguard, which operates in an excellent manner in general, leaves a transient region in which it cannot operate to its full extent, namely when two—or even more—drawers are pulled out simultaneously. This occurs, in particular, if the drawer cabinet is moved on rollers, whether it itself is provided with rollers or else is transported, for example, on a wheeled board. However, it is also conceivable that two drawers can incorrectly be pulled out at the same time. Secondly, however, the arrangement of the indexing strip according to WO-A-96/25577 is also associated with the disadvantage that even with the drawers retracted, the said indexing strip can be improperly triggered by very flat objects if such an object is introduced between two drawers and can reach the indexing strip. This improper procedure is facilitated, in particular, by the object (for example a ruler) being guided, as it were, between the drawers and hence it does not even need particular dexterity in order to permit the misuse.

It is thus first of all the object of the invention to provide a pull-out safeguard, in particular for a drawer cabinet, in which a simultaneous pulling out of two drawers is prevented and by which improper manipulations, at least of the abovementioned type, are rendered impossible.

DE-A-43 42 101 discloses a bolting device for drawers, which is likewise designed as a locking strip, in which the abovementioned problems are solved or do not even occur at all. The locking strip according to DE-A-43 42 101 comprises a multiplicity of rotational elements which are fitted on a common journal, the rotational elements also having a component which is designed in such a manner that it removes an element over a certain axial stroke during rotation of an adjacent element through a predetermined angle, the journal being fitted vertically in the piece of furniture in such a manner that at an angle of setting of the elements which does not necessitate any removal, a radial projection or a groove of each of these elements is arranged in the path of movement of a projection of a drawer which, during its opening, rotates the associated element through the predetermined angle, as a result of which it brings about the axial removal of an adjacent element and returns the rotated element back into its starting position when the drawer is closed, the journal having, on its lower part, a fixed stop with a lifting component for lifting the adjacent element during its rotation through the predetermined angle, while the upper end of the journal comprises a stop which, at a setting of elements in which no element has been rotated through the predetermined angle, is arranged at a distance from the next element which is greater than the total removal stroke, but is smaller than this total removal stroke plus the removal remaining at the end of the rotation of the element. In the case of the bolting device according to DE-A-43 42 101, the rotational elements are all designed identically and adjacent to one another, the removal component having an axial lug of an element which, in the rest position, lies in a cutout in an adjacent element, and, after rotation of the elements through a certain angle, emerges out of this cutout. The preceding description already shows the extremely complicated and complex design of the bolting device according to DE-A-43 42 101 which is thus scarcely suitable for economical and maintenance-friendly use. Furthermore, the bolting device according to DE-A-43 42 101 is not provided with the basic advantages of the device according to WO-A-96/25577. The main disadvantage of the device according to DE-A-43 42 101 lies in the attempt to provide a multistable device in which during the situation in which one of the drawers has been pulled open, a quite particular rotational device has snapped into place and therefore blocks the entire system, while in the case of the device according to WO-A-96/25577, a bistable setting is provided, in which the locking system passes, when a drawer is opened, into a bolting state which is the same for all of the drawers.

It is therefore furthermore the object of the invention to design a bolting device which can avoid the extremely complex measures of DE-A-43 42 101.

The invention achieves the above object, in this case, the measures of the invention firstly have the consequence that the device can be operated together with the locking device according to WO-A-96/25577, i.e. the measures of the invention provide additional protection, if the latter is required. This rather modular concept is to be regarded as a particular advantage of the invention. The measures of the invention provide an additional protection against misuse and a transient protection in the event that a number of drawers can be pulled open at the same time. After one drawer has been pulled open, the protection of the device according to the invention relates merely to the protection against misuse. As a result, the necessary protection measures are to be brought about with simple means in comparison with the complicated measures which are proposed in DE-A-43 42 101.

Further advantageous details of the invention are presented in the dependent claims, some of which in turn make their own inventive contribution by the basic invention described here.

The elements which are mentioned above and which are claimed and described in the following exemplary embodiments and which are to be used according to the invention are not subject in their size, shaping, material use and technical conception to any particular exception conditions, and so the selection criteria known in the respective sphere of application can be used without any restrictions.

Further details, features and advantages of the subject matter of the invention emerge from the following description of the associated drawings in which a pull-out safeguard is explained by way of example.

In the description of the following drawings, reference is made, for the basic version of a locking system, to the design according to WO-A-96/25577, the disclosure contents of which are therefore incorporated to their full extent by reference in the subject matter of the patent application present here.

In the drawings:

FIG. 1 shows a drawer cabinet which is intended for the present invention (prior art);

FIG. 2*a* shows an individual view of the conventional locking strip according to the prior art;

FIG. 2*b* shows an exploded drawing according to the view 2*a* (prior art);

FIG. 3 shows a functional illustration of the locking mechanism in which the measures of the invention have been implemented;

FIG. 4*a* shows a locking tongue according to the present invention as an oblique view;

FIG. 4*b* shows the locking tongue according to the present invention from the side;

Figure 1:
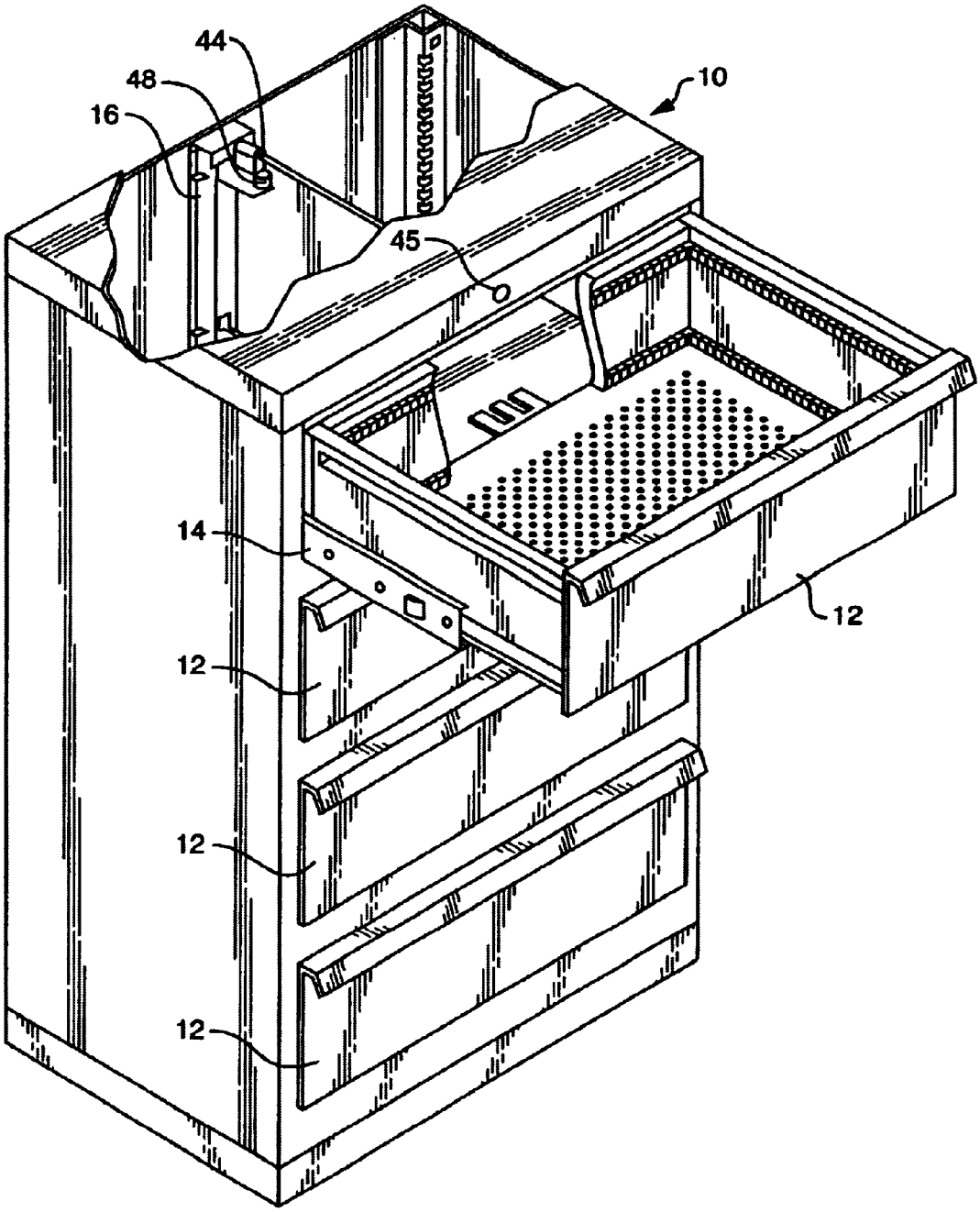
FIG. 1 (PRIOR ART)
Figure 2B:
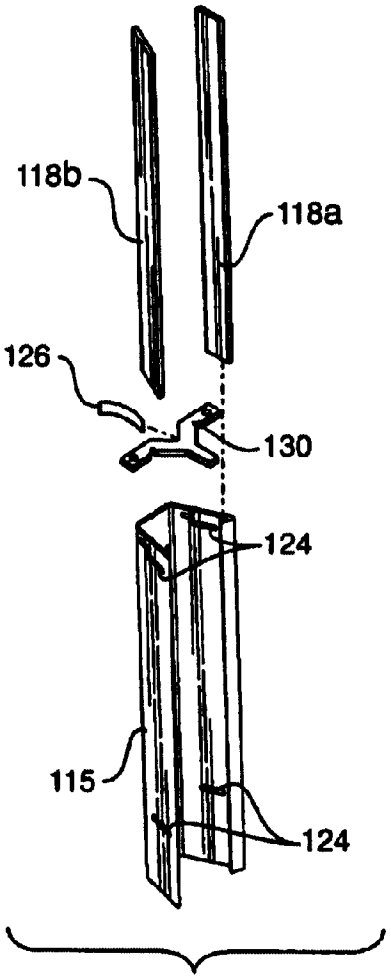
FIG. 2B (PRIOR ART)
Figure 2A:
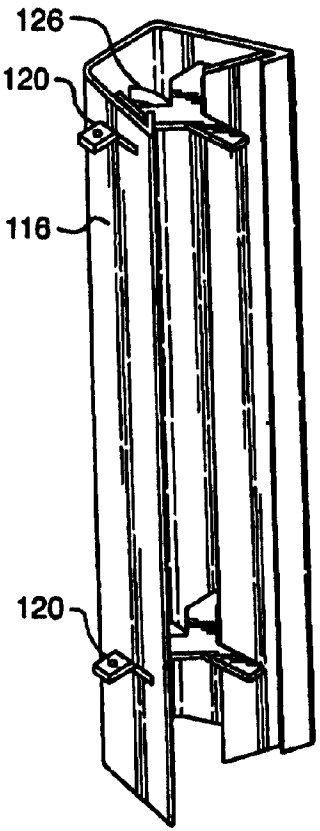
FIG. 2A (PRIOR ART)
Figure 3:
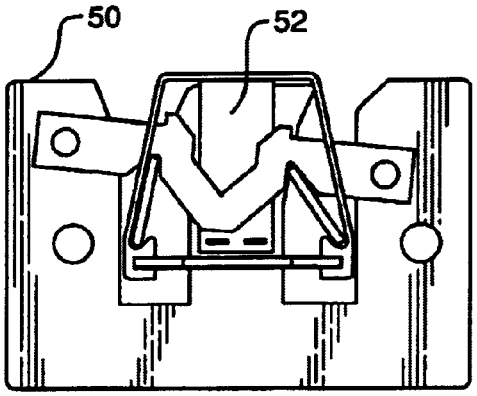

In the following text, the measures of the invention will be explained using the drawer cabinet which is disclosed in WO-A-96/25577 and is indicated as a whole by 10 in FIG. 1. The drawer cabinet 10 has a multiplicity of drawers 12. These drawers are secured by an individual pull-out safeguard 48 which is operated via a lock 46 and a securing rod 44. The drawers are guided when they move by means of guides 14. The individual pull-out safeguard is formed by the fastening profile as disclosed in WO-A-96/25577 and also in EP-A-1 035 285. The technical details of the functioning of the locking strip are illustrated in FIGS. 2*a* and 2*b* with reference being able to be made in this regard to the prior art.

As in the prior art, the locking mechanism is actuated by a locking tongue 52 which is formed on corresponding small indexing plates 50 attached to the end of the drawer. However, according to the present invention, these locking tongues have a raised element with a respective ramp 54 and 56 to the front and rear and a flat part 58 formed between the ramps. The ramp is inclined by approximately 10° to 40°, preferably by 20°, it being possible for the angle mentioned also to be able to take on a value outside the specified range.

Figure 9:
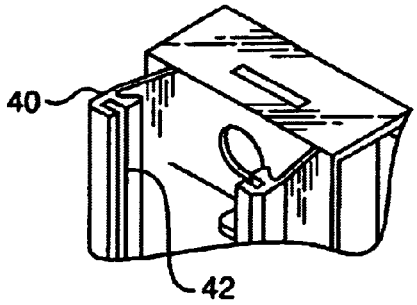
FIG. 9 shows a view of the guide groove and the sliding elements.
Figure 4B:
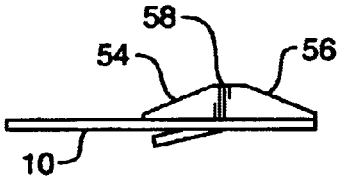
Figure 4A:
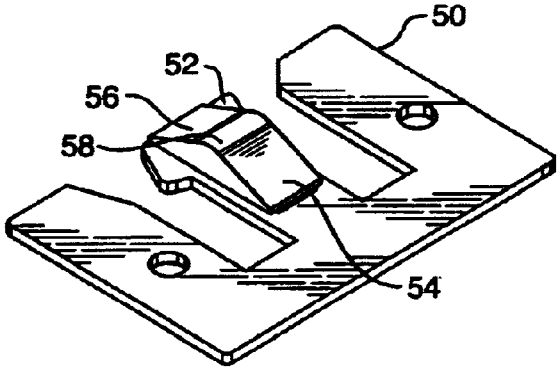
Figure 5:
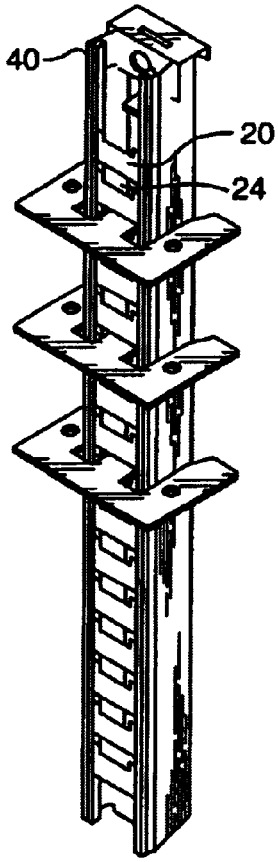
FIG. 5 shows an oblique view of the locking strip having the measures of the invention.
Figure 7:
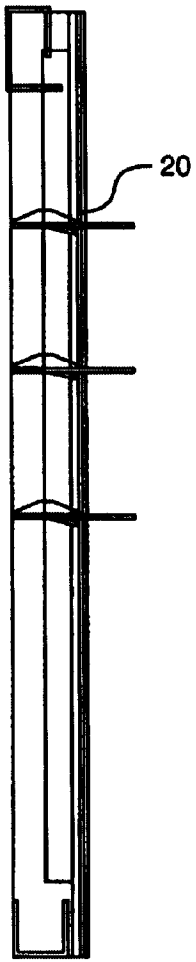
FIG. 7 shows a view according to FIG. 5 from the side of all of the drawers retracted.
Figure 6:
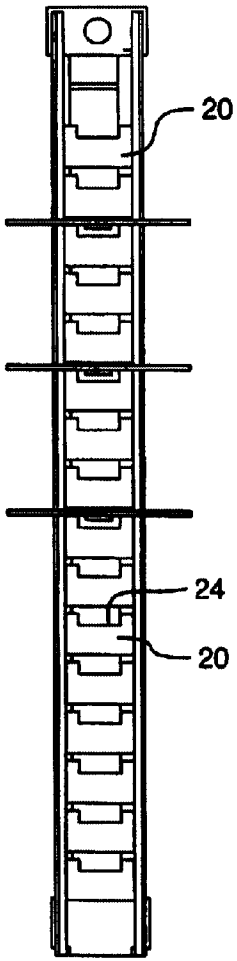
FIG. 6 shows a view according to FIG. 5 from the front.

In the present exemplary embodiment, as FIG. 9 shows, a respective guide rail 40, in which a respective guide groove 42 is formed, is fitted in front of the fastening profile. Flat small plates 20 are embedded vertically in this guide groove 42. The small plates 20 are designed in such a manner that they can slide vertically in the guide groove. They have, at the top, a rectangular cutout 24 into which the locking tongues 52 together with their additional raised elements consisting of the two ramps 54 and 56 and the flat part 58 can be moved through, albeit by the two adjacent small plates being pressed apart. In the exemplary embodiment, a small, rectangular cutout is also formed on the lower side of the small plates, which cutout functionally interacts with the upper cutout 24 on the small plate 20 arranged below it, as described above. The lowermost small plate 20 rests on a connecting element 28 to which the two guide rails 40 are connected. When the small plates 20 are pressed apart, only the small plate 20 can therefore be moved upwards above the locking tongue 52, which is formed with the raised element. Owing to the vertical arrangement of the small plates 20 in a row one above another, this is only possible if all of the small plates which are situated above the said small plate 20 also slide upwards. The rest state which is described here with the drawers 12 retracted is illustrated, in particular, in FIG. 7.

Figure 8:
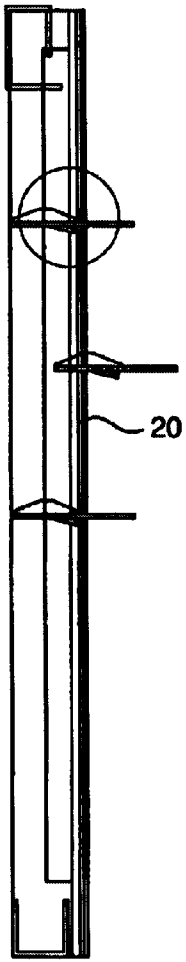
FIG. 8 shows a view according to FIG. 5, from the side, in which one drawer is in the transient state.

At the top, the guide rails 40 are likewise connected to a restricting element 26 which is designed as an upper restricting element of the movement of the small plates 20. In the situation in which all of the small plates 20 lie one above another and none of the small plates is moved upwards by any locking tongue 52, the distance of the uppermost small plate 20 from the upper connected and restricting element 26 is selected in such a manner that only a raised element, with regard to its flat part 58, passes transiently through the small plates 20 arranged in a row one above another. If the flat part 58 of a raised element is situated in an opening 24 between two small plates 20, then the uppermost small plate bears precisely against the restricting element 26. Further raising of the small plates 20 is not possible in this state, and so a further drawer 12 cannot be pulled out. This function is illustrated, in particular, in FIG. 8.

In order to render the transient pull-out safeguard effective at the start of the pulling-out of the drawers, the front ramp 54 is arranged on the locking tongue 52 in such a manner that it just bears against the associated, upper small plate with the drawer 12 completely retracted. This configuration namely has the effect that even with a small pulling-out of the drawer 12, the described process of movement of the upper small plate and all of the small plates positioned above it begins or is prevented.

If the pulled-out drawer has been pulled out beyond a certain opening distance, then the small plates 20 which are arranged above the locking tongue drop down again, and the additional locking mechanism is no longer operative. The dropping-down is defined by the position of the rear ramp 56. If, thus, the corresponding drawer 12 has been pulled out beyond a certain pull-out path, then only the pull-out safeguard according to the prior art, as disclosed, for example in WO-A-96/25577 and also in EP-A-1 035 285, is still operative in the present exemplary embodiment. However, it has to be emphasized that the additional, transient pull-out safeguard according to the present invention can interact with any other pull-out safeguard.

However, a particular measure of the invention enables the transient pull-out safeguard according to the present invention still to act in a securing manner in a further sense. This is because the small plates 20 are arranged in such a manner that a respective small plate 20 protects the intermediate space between two drawers 12. This prevents it being possible to manipulate the locking mechanism with an object which is guided between two retracted drawers 12. In the present exemplary embodiment, the opening 24 of a small plate is thus always covered by the drawer, both in the lower, resting state and in the raised state. In the present exemplary embodiment, this circumstance is ensured by the entire height of an individual small plate 20 being dimensioned at 25 mm while the opening 24 together with the—in the exemplary embodiment small, lower cutout on the small plates 20 is no more than 5–8 mm, corresponding to the flat part 58 on the locking tongue 52, with the result that the covering part of the small plate 20 always lies, both in the raised and in the lowered state, in a protective manner in front of that part of the locking strip which is accessible through the intermediate space between two drawers.

In the present exemplary embodiment, the additional, transient pull-out safeguard is of modular construction in such a manner that it does not have to be changed or adapted when different drawers 12 are inserted into the drawer cabinet 10. As already described, the height of a small plate is 25 mm in the exemplary embodiment. As a result, the modular use of drawers of a height of, for example, 25 mm, 50 mm, 75 mm, 100 mm or a further multiple of 25 mm is possible without having to adapt the pull-out safeguard in any way. Since the locking mechanism according to the prior art according to WO-A96/25577 and also according to EP-A-1 035 285 also permits different drawer heights, adaptation, which is optimal with regard to the safeguard, to different types of drawers is possible.

What is claimed is:

1. A pull-out safeguard, for a drawer cabinet with a plurality of drawers to be secured, said safeguard comprising a multiplicity of elements which are arranged essentially in a row and can be displaced, a guide means for guiding the elements which are arranged essentially in a row and can be displaced, adjusting elements which are connected to the drawers to be secured, for adjusting the vertical position of the elements which are arranged essentially in a row and can be displaced, a restricting means for restricting the displaceability of the elements which are arranged essentially in a row and can be displaced, wherein the adjusting elements interact with the drawers to be secured in such a manner that, at the beginning of a pull-out movement of one of the drawers to be secured, they move one of the elements which are arranged essentially in a row and can be displaced is and all of the other elements which are situated in one of the directions of the row, but, after a certain pull-out position of the pulled-out drawer, are moved back into their starting position by the gravitational force and/or the spring force of a spring element and/or a is different driving means driving back the elements which are arranged essentially in a row and can be displaced, the elements which are arranged essentially in a row and can be displaced are designed as essentially small flat plates having an opening profile, the adjusting elements are designed as small locking plates each having a locking tongue, the locking tongue having a ramp on each side of the pull-out movement of the corresponding drawer, and the guide means is designed as a guide rail, said elements which are around essentially in a row and can be displayed each being guided on each side in a guide groove formed in the said guide rail.

2. The safeguard according to claim 1, characterized in that an essentially flat part is farmed between said ramps on the locking tongues.

3. The pull-out safeguard according to claim 1, characterized in that the elements which are arranged essentially in a row and can be displaced are arranged essentially vertically.

* * * * *